US009289982B2

(12) United States Patent
Taff et al.

(10) Patent No.: US 9,289,982 B2
(45) Date of Patent: Mar. 22, 2016

(54) DUAL-MODE INKJET NOZZLE OPERATION

(75) Inventors: Brian M. Taff, Portland, OR (US); Erik D. Torniainen, Maple Grove, MN (US); Daniel A. Kearl, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/374,162

(22) PCT Filed: Apr. 28, 2012

(86) PCT No.: PCT/US2012/035695

§ 371 (c)(1), (2), (4) Date: Jul. 23, 2014

(87) PCT Pub. No.: WO2013/162617

PCT Pub. Date: Oct. 31, 2013

(65) Prior Publication Data

US 2015/0097884 A1 Apr. 9, 2015

(51) Int. Cl.
*B41J 2/14* (2006.01)
*B41J 2/045* (2006.01)

(52) U.S. Cl.
CPC ..... *B41J 2/04588* (2013.01); *B41J 2/0458* (2013.01); *B41J 2/04551* (2013.01); *B41J 2/04581* (2013.01); *B41J 2/04596* (2013.01); *B41J 2/14056* (2013.01)

(58) Field of Classification Search
USPC ..... 347/9, 10, 11, 19, 48, 62, 23, 57
See application file for complete search history.

(56) References Cited

U.S. PATENT DOCUMENTS

| | | | | |
|---|---|---|---|---|
| 5,502,468 | A * | 3/1996 | Knierim | 347/19 |
| 5,734,399 | A | 3/1998 | Weber et al. | |
| 6,174,038 | B1 | 1/2001 | Nakazawa et al. | |
| 6,179,411 | B1 * | 1/2001 | Saikawa et al. | 347/48 |
| 7,328,978 | B2 | 2/2008 | Silverbrook et al. | |
| 8,011,748 | B2 | 9/2011 | North et al. | |
| 2009/0322813 | A1 | 12/2009 | North et al. | |

FOREIGN PATENT DOCUMENTS

| | | |
|---|---|---|
| JP | 2005104135 | 4/2005 |
| JP | 2007210296 | 8/2007 |
| JP | 2008200855 | 9/2008 |
| KR | 413678 | 12/2003 |

OTHER PUBLICATIONS

International Search Report, dated Dec. 14, 2012, for PCT/US2012/035695, filed Apr. 28, 2012, 10 pages, English.

* cited by examiner

*Primary Examiner* — Lam Nguyen
(74) *Attorney, Agent, or Firm* — HP Inc. Patent Department

(57) ABSTRACT

An inkjet printhead includes an inkjet nozzle with a main actuator and at least one peripheral actuator in the same firing chamber. When the inkjet nozzle has sat idle, both the main actuator and the peripheral actuator are activated to jet at least one ink drop to renew the inkjet nozzle to mitigate decap conditions. When the inkjet nozzle has not sat idle, only the main actuator is activated to jet ink drops. The ink drops jetted by activating both the main and the peripheral actuators and the ink drops generated by activating only the main actuator have the same drop weight and drop velocity.

17 Claims, 4 Drawing Sheets

DUAL-MODE INKJET NOZZLE OPERATION

CROSS-REFERENCE TO RELATED APPLICATION

Pursuant to 35 U.S.C. §371, this application is a United States National Stage Application of International Patent Application No. PCT/US2012/035695, filed on Apr. 28, 2012, the contents of which are incorporated by reference as if set forth in their entirety herein.

TECHNICAL FIELD

The present disclosure is related to inkjet printers.

BACKGROUND

Drop-on-demand (DOD) inkjet printers are commonly categorized based on one of two mechanisms of drop formation. A thermal inkjet (TIJ) printer uses a heating element actuator (e.g., a thin film resistor) in an ink-filled chamber to vaporize ink and create a bubble that forces an ink drop out of a nozzle. A piezoelectric inkjet printer uses a piezoelectric material actuator on a wall of an ink-filled chamber to generate a pressure pulse that forces a drop of ink out of the nozzle.

In DOD inkjet printers that use a scanning topology, both the printhead and the substrate move to print a document. The printhead travels back and forth in one dimension of the substrate and the substrate is advanced along another (typically orthogonal) dimension. In DOD inkjet printers that use a fixed printbar topology, only the substrate moves. The printhead spans one dimension (e.g., the width) of the substrate so only the substrate is advanced along the other dimension.

For industrial and commercial applications, the page feed rates and/or the page widths are much larger than what is common in home or office settings. Sizeable page feed rates and/or page widths are not well suited for the scanning topology as the scanning printheads would have to raster at speeds far in excess of what could be reliably supported without extremely costly mechanical components. Thus the fixed printbar format is better suited for the industrial and commercial applications. The fixed printhead format is also well suited for home or office settings as it offers greater print speed than the scanning format for the same printer footprint.

BRIEF DESCRIPTION OF THE DRAWINGS

In the drawings.

Use of the same reference numbers in different figures indicates similar or identical elements.

DETAILED DESCRIPTION

Figure 1:
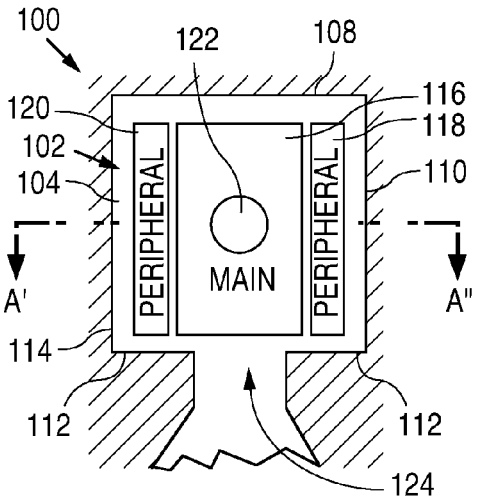
FIG. 1 is a plan view of a nozzle of an inkjet printhead in one example of the present disclosure.

For inkjet printheads and pens, a problem known as "decap" arises when nozzles sit in a non-jetting state while exposed to the open atmosphere for a span of time, and subsequently receive a request to jet. As the nozzles return to actuation following such an idle period, they may display a number of non-ideal characteristics that include missing drops, mis-directed drops, weak drops, and even drops that are enriched or depleted in color compared to the bulk ink. Drops that misbehave in such manners frustrate attempts to facilitate high-quality image production. As design efforts drive toward fixed printbar jetting topologies (displacing scan-based approaches) and single-pass print modes, decap issues stand to grow even more pronounced as a larger number of nozzles will occupy non-jetting states at any given time.

Decap responses can be grouped into two general but separate categories. In pigmented ink systems, the evaporation of water from the open bores may cause the ink's pigment and the remaining vehicle in the firing chamber to self-sequester into partitioned zones. This phenomenon is referred to as pigment-ink-vehicle separation (PIVS). Alternatively, the evaporation of water from the open bores may also serve to increase the viscosity of ink within the jetting architecture and thereby create another decap dynamic from the formation of either in-bore or in-chamber viscous plugs.

Examples of the present disclosure provide techniques for addressing decap responses and aim to enable "instant on" nozzles. The examples of the present disclosure renew nozzle health following periods during which nozzles have not jetted and sat exposed to ambient atmospheric conditions. The examples of the present disclosure address viscous plug decap modes and, to a lesser extent, the PIVS decap dynamic. The examples of the present disclosure use multiple distinct resistors positioned within a commonly shared firing chamber. A bulk of the time the nozzle jets by actuating a main resistor alone in a "normal" firing mode. This main resistor is tuned to the chamber geometries to produce the desired drop weight and drop velocity values. Following an idle period during which water evaporates through the exposed in-bore meniscus and the ink within the firing chamber becomes increasingly viscous compared to bulk ink supply, the main resistor and one or more additional peripheral resistors in the same firing chamber are actuated simultaneously (or substantially simultaneously). This actuation is used to clear the more viscous in-chamber and/or in-bore "fouled" ink to produce drop weight and drop velocity values commensurate with non-fouled bulk ink. After the "boost" firing mode, where both the main and the one or more peripheral resistors are actuated, the nozzle resumes "normal" firing mode operation by firing the main resistor alone.

With the "boost" firing mode available for use and operating as desired, every drop ejected from any nozzle realizes the same (or substantially the same) drop weight and drop velocity regardless of its idle time history. In other words, the "boost" firing mode enables the printhead to eject drops following idle spans and have those drops behave as if the idle span (and its deleterious affiliate effects) had never occurred. The "boost" firing mode may operate for the first (or first few) firings that follow benchmarked idle periods.

Figure 2:
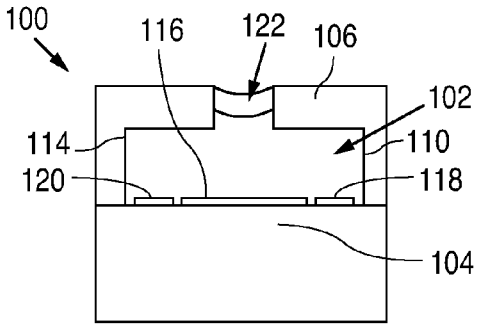
FIG. 2 is a side cross-sectional view of the nozzle of FIG. 1 taken across a line A'A" in the plan view of FIG. 1 in one example of the present disclosure.

FIG. 1 is a top plan view of a nozzle 100 of an inkjet printhead in one example of the present disclosure. FIG. 2 is a side cross-sectional view of nozzle 100 taken across a line A'A" across the plan view of FIG. 1 in one example of the present disclosure. Referring to FIGS. 1 and 2, nozzle 100 includes a firing chamber 102. In one example, chamber 102 has a substrate 104, an orifice layer 106, and ink barriers 108, 110, 112, and 114 that extend from substrate 104 to orifice layer 106. Substrate 104 forms the floor of chamber 102. Orifice layer 106 forms the ceiling of chamber 102. Ink barriers 108, 110, 112, and 114 form the sidewalls of chamber 102. A main actuator 116 is centered on floor 104 and flanked by two peripheral actuators 118 and 120. Ceiling 106 defines an orifice 122 for ejecting ink drops. In one example, orifice 122 is centered over main actuator 116. In one example, sidewall 112 defines an ink inlet or pinch 124 for receiving bulk ink from an ink feed supply slot. In other examples, sidewall 112 may not exist and sidewalls 110 and 114 may extend vertically until they interface with an ink feed supply slot.

In one example, actuators 116, 118, and 120 are rectangular thin film resistors. Main resistor 116 is centered on floor 104 with peripheral resistor 118 on its right side and peripheral resistor 120 on its left side. Main resistor 116 has its bottom side proximate to pinch 124 in wall 112. Peripheral resistors 118 and 120 each may have the same length but a smaller width than main resistor 116. In describing a rectangular thin film resistor, the longer dimension of the rectangular thin film resistor is the direction along which electric current flows and is referred to as the length regardless of resistor orientation, and the shorter dimension of the rectangular thin film resistor, the direction orthogonal to current flow, is referred to as its width regardless of the resistor orientation. In other examples, actuators 116, 118, and 120 are other types of heating element or piezoelectric material actuators.

After nozzle 100 sits idle for a period of time long enough to develop a decap condition (e.g., a viscous plug within orifice 122 and/or firing chamber 102), main resistor 116 and peripheral resistors 118, 120 are concurrently (or substantially concurrently) actuated in a "boost" firing mode. The "boost" firing mode ejects one or more ink drops having drop weight and drop velocity values that match (or substantially match) healthy ink drops associated with a "normal" firing mode (which would only actuate the main resistor) for a healthy nozzle 100 (i.e. one that has been actively jetting and not degraded by the ill-effects of any decap dynamics). Main resistor and peripheral resistors 118, 120 are substantially concurrently actuated if they are fired within a fraction of a millisecond. The ink drop under the "boost" firing mode substantially matches the healthy ink drops of the "normal" firing mode in a healthy nozzle 100 if they share drop weight and drop velocity values within approximately 10% of one another. After nozzle 100 is renewed from operating in the "boost" firing mode, only main resistor 116 is actuated in the "normal" firing mode to eject ink drops. The shape, size, and relative sizes of the main resistor 116 and peripheral resistors, as well as the shape and size of the firing chamber 102, can be tailored to the specific application. Additionally, the number of times both main resistor 116 and peripheral resistors 118, 120 are actuated in the "boost" mode is tunable and application specific as it depends on a number of factors such as the output artwork (e.g. area fills versus line art) and the ink properties.

Figure 3A:
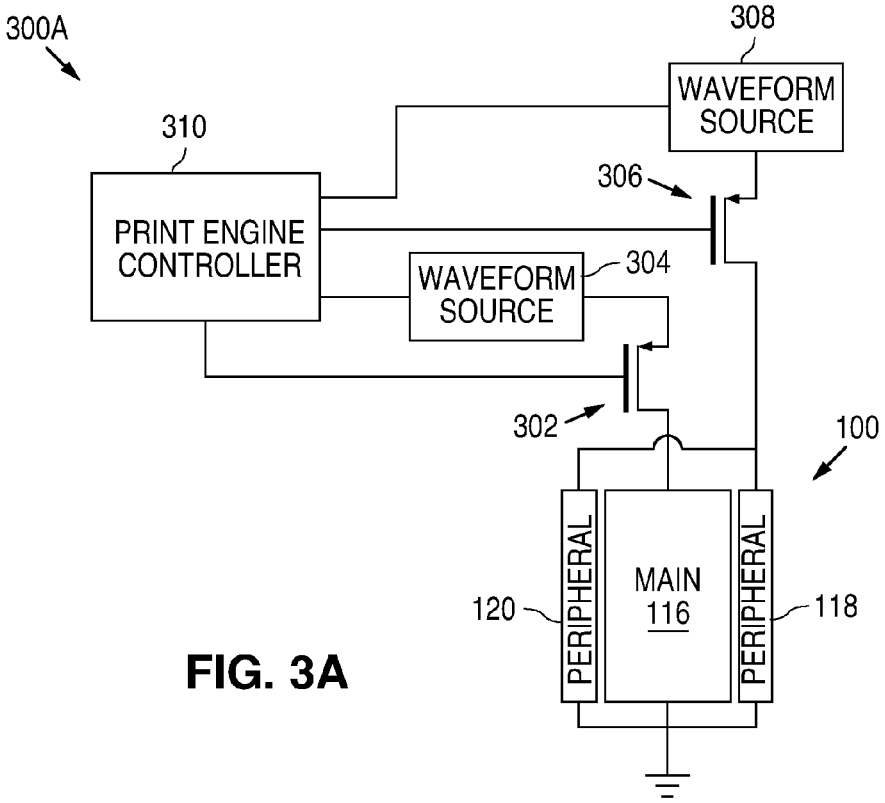
FIG. 3A is an electronic schematic of an inkjet apparatus with the nozzle of FIG. 1 in one example of the present disclosure.

FIG. 3A is an electronic schematic for an inkjet apparatus 300A including nozzle 100 in one example of the present disclosure. Apparatus 300A includes a switch 302 that selectively couples a waveform source 304 to main resistor 116, a switch 306 that selectively couples a waveform source 308 to peripheral resistors 118, 120, and a print engine controller 310 that controls switches 302, 306 and waveform sources 304, 308. Waveform sources 304 and 308 generate one or more waveforms under the command of print engine controller 310. Apparatus 300A is in a high-side switch configuration as switches 302, 306 are located between waveform sources 304, 308 and resistors 116, 118, 120.

In one example, switches 302 and 306 are field effect transistors. Transistor 302 has its gate connected to receive a first control signal from print engine controller 310, its drain connected to receive a pulse train from waveform source 304, and its source connected to an anode of main resistor 116. Transistor 306 has its gate connected to receive a second control signal from print engine controller 310, its drain connected to receive a pulse train from waveform source 308, and its source connected to anodes of peripheral resistors 118, 120. Resistors 116, 118, and 120 have their cathodes connected to ground.

In operation, print engine controller 310 turns on and off transistors 302 and 306 to selectively couple waveform sources 304 and 308 to main resistor 116 and peripheral resistors 118, 120, respectively. Print engine controller 310 also signals waveform sources 304 and 308 to generate the appropriate pulse trains for main resistor 116 and peripheral resistors 118, 120, respectively. Print engine 310 may be an application specific integrated circuit or a processor executing machine readable instructions. Although two waveform sources 304 and 308 are shown, a single waveform source may be used to drive main resistor 116 and peripheral resistors 118, 120.

Figure 3B:
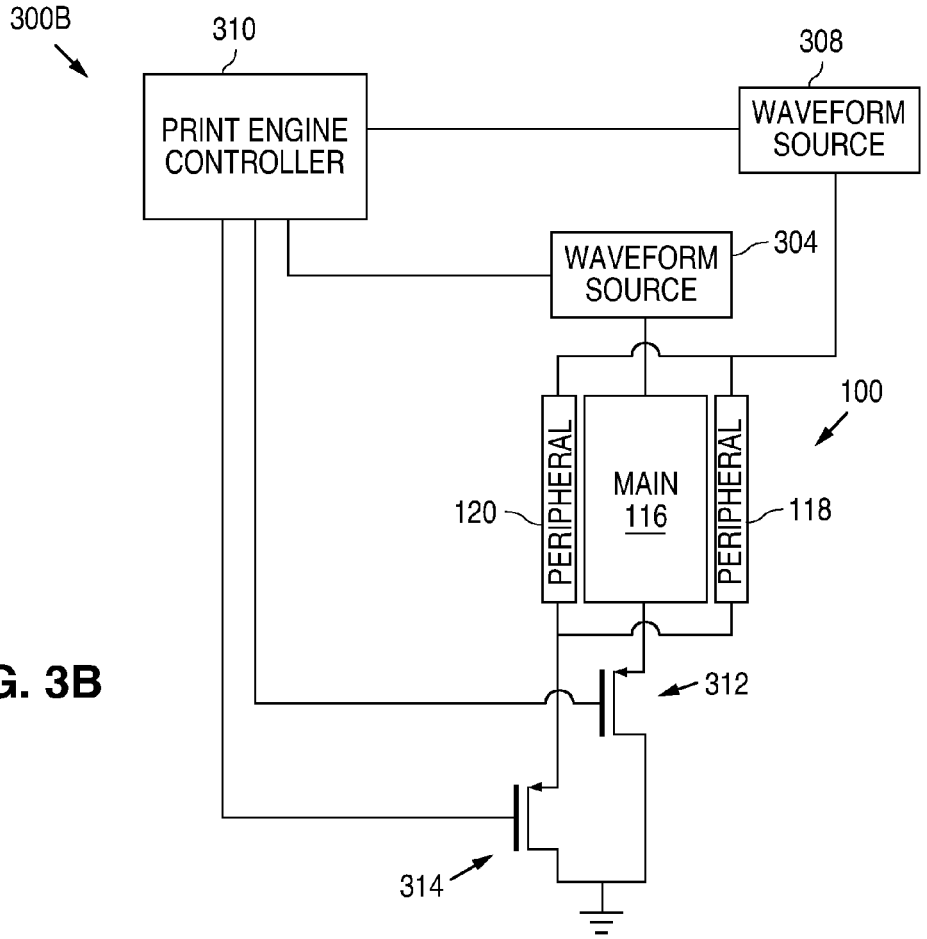
FIG. 3B is an electronic schematic of an inkjet apparatus with the nozzle of FIG. 1 in one example of the present disclosure.

FIG. 3B is an electronic schematic for an inkjet apparatus 300B including nozzle 100 in one example of the present disclosure. Apparatus 300B includes waveform source 304 connected to the anode of the main resistor 116, waveform source 308 connected to the anodes of peripheral resistors 118, 120, a switch 312 that selectively couples the cathode of main resistor 116 to ground, a switch 314 that selectively couples the cathodes of peripheral resistors 118, 120 to ground, and a print engine controller 310 that controls switches 310, 312 and waveform sources 304, 308. Apparatus 300B is in a low-side switch configuration as switches 310, 312 are located between resistors 116, 118, 120 and ground.

In one example, switches 312 and 314 are field effect transistors. Transistor 312 has its gate connected to receive a first control signal from print engine controller 310, its drain connected to the cathode of main resistor 116, and its source connected to ground. Transistor 314 has its gate connected to receive a second control signal from print engine controller 310, its drain connected to the cathodes of peripheral resistors 118, 120, and its source connected to ground.

In operation, print engine controller 310 turns on and off transistor 312 to selectively complete the circuit from waveform sources 304 through main resistor 116 to ground. Print engine controller 310 turns on and off transistor 314 to selectively complete the circuit from waveform source 308 through peripheral resistors 118, 120 to ground.

Figure 4:
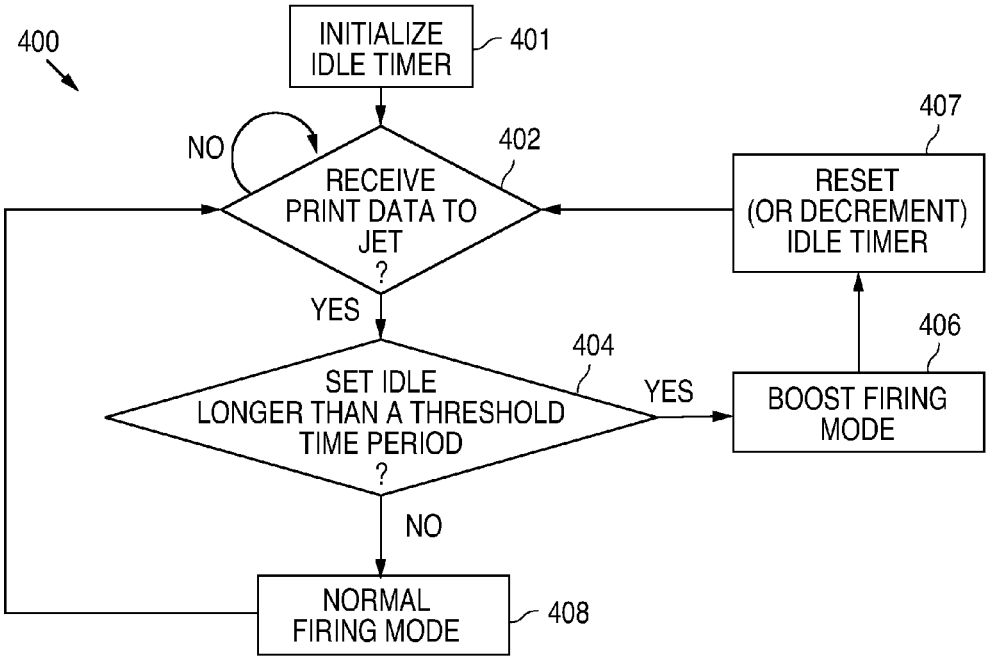
FIG. 4 is a flowchart for a method to operate the nozzle of FIG. 1 in one example of the present disclosure.

FIG. 4 is a flowchart for a method 400 to operate nozzle 100 (FIGS. 1 and 2) in one example of the present disclosure.

Method 400 may be implemented by print engine controller 310 (FIG. 3). Method 400 begins in block 401.

In block 401, print engine controller 310 initializes a timer for tracking idle time for nozzle 100 at the beginning of method 400. Block 401 is followed by block 402.

In block 402, print engine controller 310 determines if it has received print data for nozzle 100 to jet. If so, block 402 is followed by block 404. Otherwise block 402 loops back to itself until print engine 310 receives print data for nozzle 100 to jet.

In block 404, print engine controller 310 determines if nozzle 100 has sat idle for too long by checking the current value of the idle timer against a threshold time period. When the current value of the idle timer is greater than the threshold time period, nozzle 100 has sat idle for too long and block 404 is followed by block 406. Otherwise block 404 is followed by block 408. The threshold time period is tunable and application specific as it depends on a number of factors such as the chamber dimensions, ambient environment, and the ink properties. The threshold time period may be as short as a fraction of a second to as long as a few seconds, tens or seconds, or minutes.

In block 406, print engine controller 310 enters a boost firing mode where it simultaneously (or substantially simultaneously) activates (e.g., pulses) both main resistor 116 and peripheral resistors 118, 110 (FIGS. 1 and 2). In one example, print engine controller 310 pulses both main resistor 116 and peripheral resistors 118, 110 once to jet one ink drop. Block 406 may be followed by block 407.

In block 407, print engine controller 310 resets the idle timer in one example. In another example, print engine controller 310 decrements the idle timer by a predetermined amount. The predetermined amount by which the idle timer is decremented may be selected so that the first few drops following an idle period operate under the boost firing mode before method 400 loops through block 408 and operate in a normal firing mode. Block 407 loops back to block 402 to wait for a subsequent set of print data for nozzle 100 to jet.

In block 408, print engine controller 310 enters the normal firing mode where it activates (e.g., pulses) only main resistor 116. In one example, print engine controller 310 pulses main resistor 116 once to jet one ink drop. Block 408 loops back to block 402 to repeat method 400.

As discussed above, any ink drop jetted in the "boost" firing mode has the same (or substantially the same) drop weight and drop velocity values as the healthy ink drops jetted in the "normal" firing mode for a healthy, non-decapped, nozzle 100 because the "boost" firing mode commences after nozzle 100 has sat idle and the fouling of the in-nozzle ink (and its typical affiliate degradation in drop velocity and drop weight values) is deliberately offset by the enhanced ejection capabilities delivered by the added actuation footprint associated with the extra in-chamber resistors.

Figure 5A:
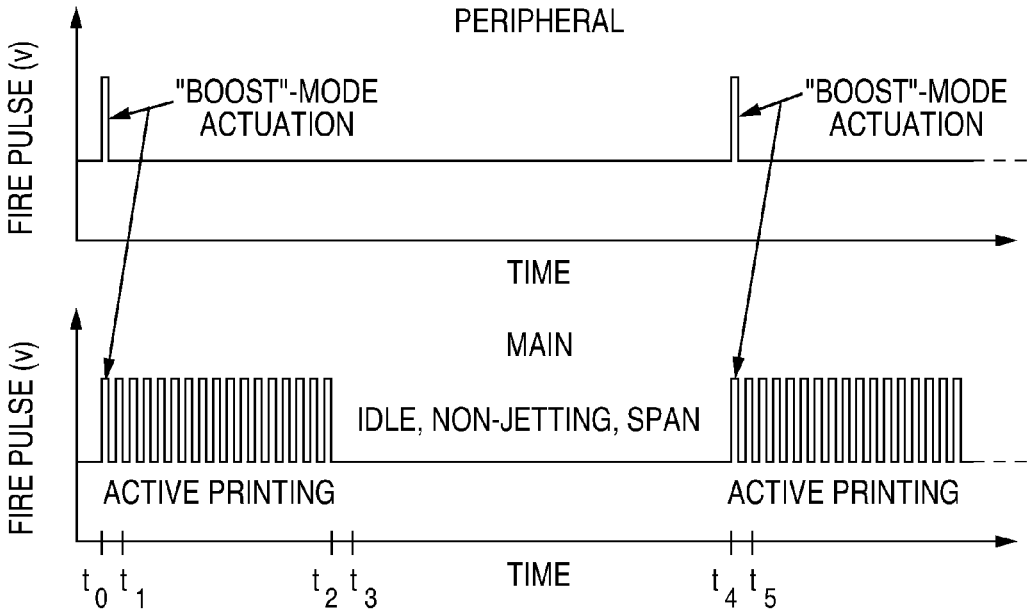
FIG. 5A is an example of a timing diagram of waveforms supplied to main and peripheral resistors in the nozzle of FIG. 1 in one example of the present disclosure.

FIG. 5A is an example of a timing diagram of waveforms supplied to main resistor 116 and peripheral resistors 118, 120 in one example of the present disclosure. From time t0 to t1, nozzle 100 (FIGS. 1 and 2) operates in the "boost" firing mode during which both main resistor 116 and peripheral resistors 118, 120 (FIGS. 1 and 2) are pulsed once to jet an ink drop to renew nozzle 100. In one example, main resistor 116 receives a waveform A during "normal" firing mode, and main resistor 116 and peripheral resistors 118, 120 receive the same waveform A during "boost" firing mode. In another example, main resistor 116 receives waveform A during "normal" firing mode, and main resistor 116 and peripheral resistors 118, 120 receive a different waveform B during "boost" firing mode. In this example, waveforms A and B differ in duration but in other examples they may differ in amplitude, phase, duration, or a combination thereof. In an additional example, main resistor 116 receives a waveform B1 and peripheral resistors 118, 120 receive a different waveform B2 during "boost" firing mode. In this example, waveforms B1 and B2 differ in duration but in other examples they may differ in amplitude, phase, duration, or a combination thereof.

From time t1 to t2, nozzle 100 actuates in the "normal" firing mode during which main resistor 116 is pulsed multiple times to jet a number of ink drops. From time t2 to t3, nozzle 100 sits idle greater than the threshold period of time so print engine 310 enters the "boost" firing mode any time after time t3.

From time t4 to t5, nozzle 100 operates in the "boost" firing mode during which both main resistor 116 and peripheral resistors 118, 120 are pulsed once to jet an ink drop to renew nozzle 100. At time t5, nozzle 100 enters the normal firing mode during which main resistor 116 is pulsed multiple times to jet a number of ink drops.

The description outlined above is illustrative in nature and, as such, should not be interpreted to specifically mandate that only a single "boost" mode spit be leveraged before "normal" mode pulsing resumes. In some ink and printer systems there may be a need to tune the number of "boost" mode spits to values higher than one to ensure that every drop leaving orifice 122 (FIGS. 1 and 2), regardless of the nozzle's idle time or operational history, jets with a common velocity and weight.

Figure 5B:
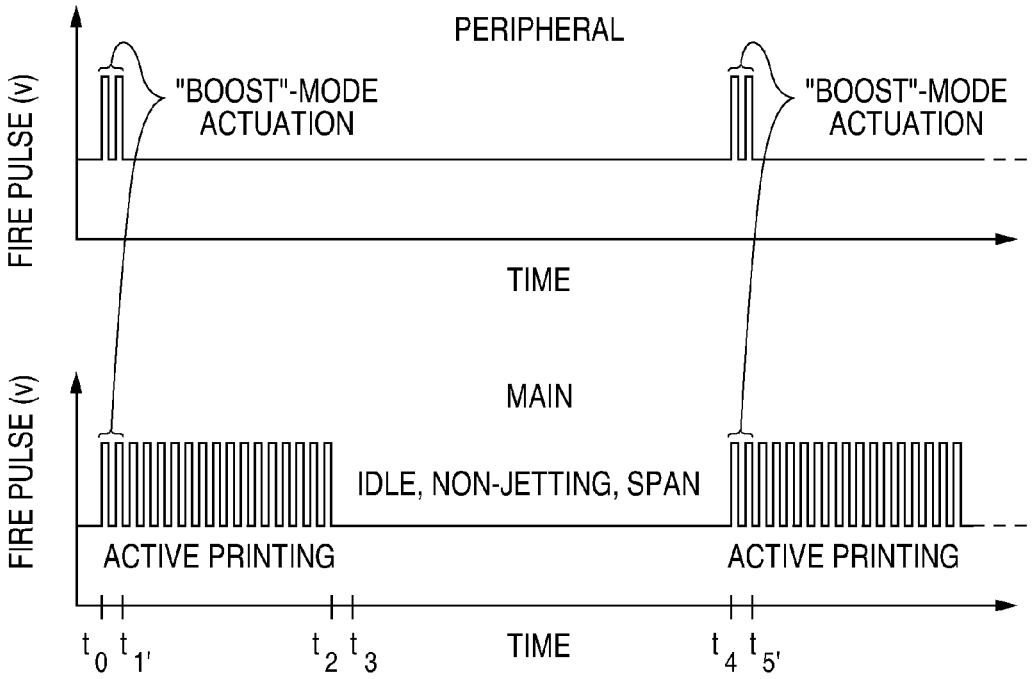
FIG. 5B is an example of a timing diagram of waveforms supplied to main and peripheral resistors in the nozzle of FIG. 1 in one example of the present disclosure.

FIG. 5B is an example of a timing diagram of waveforms that utilizes two boost mode spits before normal mode resumes in one example of the present disclosure. From time t0 to t1', nozzle 100 (FIGS. 1 and 2) operates in the boost firing mode during which both main resistor 116 and peripheral resistors 118, 120 (FIGS. 1 and 2) are pulsed multiple times (e.g., twice) to jet a number of ink drops (e.g., two ink drops) to renew nozzle 100. Note that it is the artwork that causes nozzle 100 to jet multiple times (e.g., there are two drops to be printed on the page) and nozzle 100 is not fired twice for the sake of renewing its health even though the artwork called for a single drop to be printed on the page. In one example, main resistor 116 and peripheral resistors 118, 120 receive the same waveform. In another example, main resistor 116 and peripheral resistors 118, 120 receive waveforms that may differ in duration, amplitude, phase, or a combination thereof. In either case, the waveform received by main resistor 116 during the "boost" firing mode may be different from the waveform received by main resistor 116 during the normal firing mode.

From time t1' to t2, nozzle 100 actuates in the "normal" firing mode during which main resistor 116 is pulsed multiple times to jet a number of ink drops. Note that it is the artwork that forces nozzle 100 to jet multiple times (i.e. there are multiple drops to be printed on the page). From time t2 to t3, nozzle 100 sits idle greater than the threshold period of time so print engine 310 enters the boost firing mode any time after time t3.

From time t4 to t5', nozzle 100 operates in the "boost" firing mode during which both main resistor 116 and peripheral resistors 118, 120 are pulsed multiple times (e.g., twice) to jet a number of ink drops (e.g., two) to renew nozzle 100. At time t5', nozzle 100 enters the "normal" firing mode during which main resistor 116 is pulsed multiple times to jet a number of ink drops.

Figure 6:
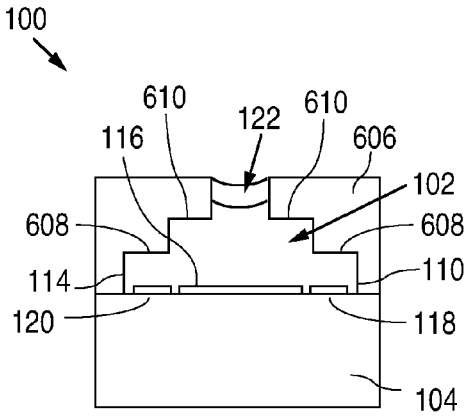
FIG. 6 is a cross-sectional view of a variation of the nozzle of FIG. 1 taken across line A'A" in the plan view of FIG. 1 in another example of the present disclosure.

FIG. 6 is a cross-sectional view of a variation of nozzle 100 (FIG. 1), hereafter referred to as nozzle 600, taken across line A'A" in FIG. 1 in one example of the present disclosure. Nozzle 600 is similar to nozzle 100 except that it utilizes a tray ceiling 606 where a perimeter 608 of the ceiling is of one height and an interior 610 of the ceiling is of a greater height. The lower perimeter 608 of ceiling 606 introduces a localized chamber height in portions of the design not affiliated with main resistor 116. These localized regions are dimensionally constrained such that any remnant bubbles accumulating within portions of the firing chamber 102 over peripheral resistors 118, 120 (after firing sequences) would be required to have extremely high internal bubble pressures. The high internal bubble pressures would, in turn, cause the bubbles to shrink and collapse as their internal air pressures would force the gases back into solution. These constricted portions of the firing chamber would also serve as barriers for preventing larger remnant bubbles from physically occupying locations above peripheral resistors 118, 120.

Figure 7:
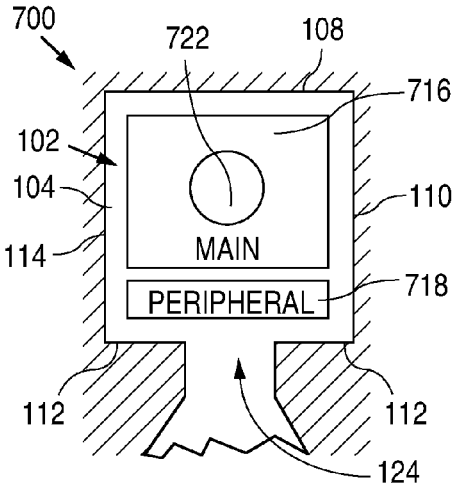
FIG. 7 is a plan view of a nozzle of an inkjet printhead in one example of the present disclosure.

FIG. 7 is a plan view of a nozzle 700 of an inkjet printhead in one example of the present disclosure. Nozzle 700 is similar to nozzle 100 except that it utilizes a main resistor 716 and a peripheral resistor 718. Resistors 716, 718 are rectangular thin film resistors. Main resistor 716 is seated on floor 104 away from pinch 124 in wall 112. Peripheral resistor 718 is seated on floor 104 between main resistor 716 and pinch 124. Peripheral resistor 718 has the same length but shorter width than main resistor 716. As discussed above, the longer dimension of a rectangular thin film resistor is referred to as the length regardless of orientation, and the shorter dimension of the rectangular film resistor is referred to as its width regardless of orientation. An orifice 722 is centered (left/right) within chamber 102 and either stationed directly above main resistor 716 or at other locations along the axis spanning from the center of wall 108 to the center of pinch 124. The placement of peripheral resistor 718 on the slot side of main resistor 716 allows ink that flushes back into chamber 102 (after jetting events) to force any entrapped air toward orifice 722. Using the refill to push air bubbles toward orifice 722 allows the air bubbles to vent out of firing chamber 102 and thereby leaves a fully-refilled nozzle 100 in place for a healthy firing.

Figure 8:
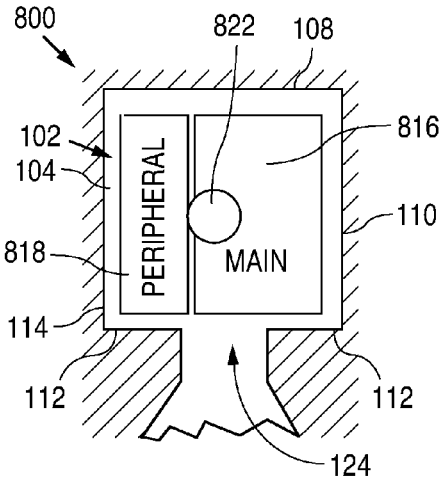
FIG. 8 is a plan view of a nozzle of an inkjet printhead in one example of the present disclosure and FIG. 9 is a plan view of a nozzle of an inkjet printhead in one example of the present disclosure.

FIG. 8 is a top plan view of a nozzle 800 of an inkjet printhead in one example of the present disclosure. Nozzle 800 is similar to nozzle 100 except that it utilizes a main resistor 816 and a peripheral resistor 818. Resistors 816 and 818 are rectangular thin film resistors. Main resistor 816 sits offset on one side of floor 104 and peripheral resistor 818 is stationed adjacent to main resistor 816. This arrangement simplifies trace routing to switches and ground, increases packing density (as there is less spacing between the resistors), and enhances the thermal efficiencies of the added resistor footprint in generating a boost response.

In one example, pinch 124 is centered on wall 112. In other examples, pinch 124 may be offset toward peripheral resistor 818 to use the refill of chamber 102 to purge potential trapped air bubbles in chamber 102. Peripheral resistor 818 may have the same length but a smaller width than main resistor 816. An orifice 822 is typically centered above chamber 102.

Figure 9:
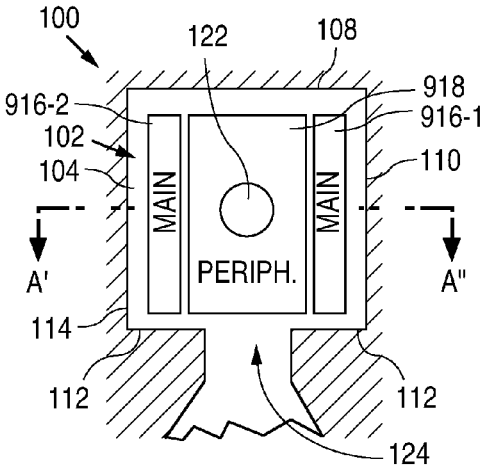

FIG. 9 is a top plan view of a nozzle 900 of an inkjet printhead in one example of the present disclosure. Nozzle 900 is a variation of nozzle 100 (FIG. 1). Specifically the roles of the main and the peripheral resistors have been swapped. Peripheral resistors 118 and 120 (FIG. 1) in nozzle 100 are now main resistors 916-1 and 916-2 in nozzle 900, respectively, and main resistor 116 (FIG. 1) in nozzle 100 is now a peripheral resistor 918 in nozzle 900. Circuits 300A (FIG. 3A) and 300B (FIG. 3B) are modified accordingly to supply the appropriate waveforms to main resistors 916-1, 916-2 and peripheral resistor 918.

The examples of the present disclosure offer a systems-level avenue for "instant on" nozzles where every drop ejected from the printhead presents uniform (or substantially uniform) drop weight and drop velocity regardless of their jetting history. The examples of the present disclosure allow decap management to be offloaded from the ink formulations and servicing routines to a built-in printer system design. As such, new latitudes are provided for (1) designing inks that can chase performance metrics other than decap, (2) reducing non-printing spits which factor into the spittoon sizing and other printer design considerations, and (3) decoupling nozzle renewal capabilities from nozzle count scaling—offering the capacity to dramatically improve the reliability of printheads without a debilitating growth in off-die servicing hardware for bar-based implementations.

Various other adaptations and combinations of features of the examples disclosed are within the scope of the disclosure. Numerous examples are encompassed by the following claims.

What is claimed is:

1. A method for operating an inkjet nozzle, comprising:

operating in a boost firing mode when the inkjet nozzle has sat idle, comprising:

pulsing both a main resistor and at least one peripheral resistor in a firing chamber of the inkjet nozzle to jet a first ink drop; and operating in a normal firing mode after operating in the boost firing mode, comprising:

pulsing only the main resistor to jet a second ink drop, wherein the first and the second ink drops have substantially the same drop weight and drop velocity as a healthy ink drop.

2. The method of claim 1, comprising:

determining, if the inkjet nozzle has sat idle before operating in the boost firing mode, wherein the inkjet nozzle has sat idle when the inkjet nozzle has not jetted for a threshold period of time.

3. The method of claim 2, comprising:

initializing a timer to track idle time before jetting any ink drop;

determining if the inkjet nozzle has sat idle by comparing a current value of the timer to a threshold time period; and after operating in the boost firing mode, decrementing the timer by a preset amount of time.

4. The method of claim 1, wherein:

pulsing both the main resistor and the at least one peripheral resistor comprises supplying a pulse wave to the main resistor and the at least one peripheral resistor; and pulsing, only the main resistor comprises supplying the pulse wave to the main resistor.

5. The method of claim 1, wherein:

pulsing both the main resistor and the at least one peripheral resistor comprises supplying a first pulse wave to the main resistor and the at least one peripheral resistor; and pulsing only the main resistor comprises supplying a second pulse wave to the main resistor, wherein the first and the second pulse waves are different.

6. An inkjet printhead, comprising:

an inkjet nozzle, comprising:

a firing chamber defining an orifice;

a main actuator located in the firing chamber; and at least one peripheral actuator located adjacent to the main actuator in the firing chamber; and a print engine comprising:

a boost mode that operates when the inkjet nozzle has sat idle, the boost mode comprises actuating simultaneously the main actuator and the at least one peripheral actuator to jet at least one ink drop; and a normal mode that operates when the inkjet nozzle has not sat idle, the normal mode comprising actuating only the main actuator to jet a plurality of ink drops, wherein the at least one ink drop and the plurality of ink drops have substantially the same drop weight and drop velocity.

7. The inkjet printhead of claim 6, wherein:

the main actuator and the at least one peripheral actuator comprises a main resistor flanked by two peripheral resistors; and the orifice is centered along an axis from a back wall of the firing chamber to a center of an ink inlet of the firing chamber.

8. The inkjet printhead of claim 6, wherein:

the main actuator and the at least one peripheral actuator comprises a main resistor and a peripheral resistor; and the peripheral resistor is located between the main resistor and an ink inlet of the firing chamber.

9. The inkjet printhead of claim 6, wherein:

the main actuator and the at least one peripheral actuator comprises a main resistor and a peripheral resistor; and the main resistor is offset to one side of the firing chamber and flanked on the other side by the peripheral resistor.

10. The inkjet printhead of claim 6, wherein:

the at least one main actuator and the at least one peripheral actuator comprises a peripheral resistor flanked by two main resistors; and the orifice is centered along an axis from a back wall of the firing chamber to a center of an ink inlet of the firing chamber.

11. The inkjet printhead of claim 6, wherein the inkjet nozzle further comprises first and second transistors controlled by the print engine to connect the main actuator to the at least one peripheral actuator and to the at least one waveform source.

12. The inkjet printhead of claim 6, wherein the main actuator and the at least one peripheral actuator are selected from the group consisting of resistive heating element actuators and piezoelectric material actuators.

13. The inkjet printhead of claim 6, wherein the firing chamber comprises a tray ceiling with multiple heights over the main actuator and the at least one peripheral actuator.

14. The inkjet printhead of claim 6, wherein a substrate forms the floor of the firing chamber and the orifice forms the ceiling of the firing chamber.

15. The inkjet printhead of claim 6, wherein ink barriers form a sidewall of the firing chamber, wherein the sidewall defines an ink inlet for receiving bulk ink from an ink feed supply slot.

16. The inkjet printhead of claim 6, wherein the at least one peripheral actuator comprises at least two peripheral actuators.

17. The inkjet printhead of claim 6, wherein the print engine is to determine whether the inkjet nozzle has sat idle.

* * * * *